United States Patent [19]

Bunnell

[11] 4,080,717

[45] Mar. 28, 1978

[54] TELEPHONE CABLE SPLICING APPARATUS

[75] Inventor: Edward Dennman Bunnell, Palm Harbor, Fla.

[73] Assignee: AMP Incorporated, Harrisburg, Pa.

[21] Appl. No.: 707,981

[22] Filed: Jul. 23, 1976

[51] Int. Cl.[2] ..... H01R 43/04

[52] U.S. Cl. ..... 29/566.4; 29/750; 29/751; 29/760

[58] Field of Search ..... 29/748–752, 29/760, 628, 566.3, 566.4

[56] References Cited

U.S. PATENT DOCUMENTS

| | | | |
|---|---|---|---|
| 3,866,293 | 2/1975 | Nijman | 29/749 X |
| 3,953,925 | 5/1976 | Wilson | 29/749 X |

*Primary Examiner*—Carl E. Hall

*Attorney, Agent, or Firm*—Robert W. Pitts; Frederick W. Raring; William J. Keating

[57] ABSTRACT

An apparatus is disclosed for electrically connecting groups or bundles of wires to each other by means of a connector which has a plurality of displation type contacts therein arranged in parallel rows. The apparatus comprises a frame having means thereon for holding the connector and a wire guide means for locating the wires in alignment with the terminals in the connector. The wires are trimmed and inserted by means of a roller which is mounted on the frame and which is moved along a working stroke path which extends parallel to the length of the connector. The wire guide means can be selectively positioned relative to the connector to locate the wires in alignment with different groups of terminals in the connector.

15 Claims, 15 Drawing Figures

66
68
72
70
126
74
10
80
86
90
82
84
78
96
100'
102
95
76
94'
98'
6
8
2
3
148
168
129
128
130
134
136
132
4'
2'
162'
64
164'
160'
158'
158
62
160
164
4
162

Fig 3
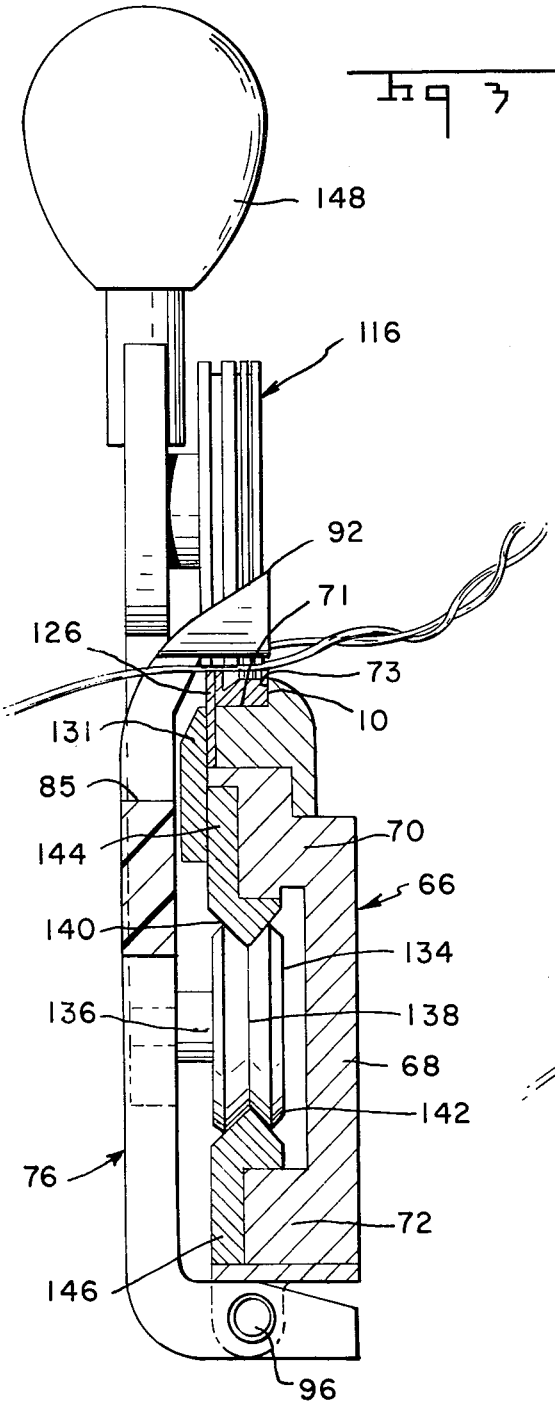
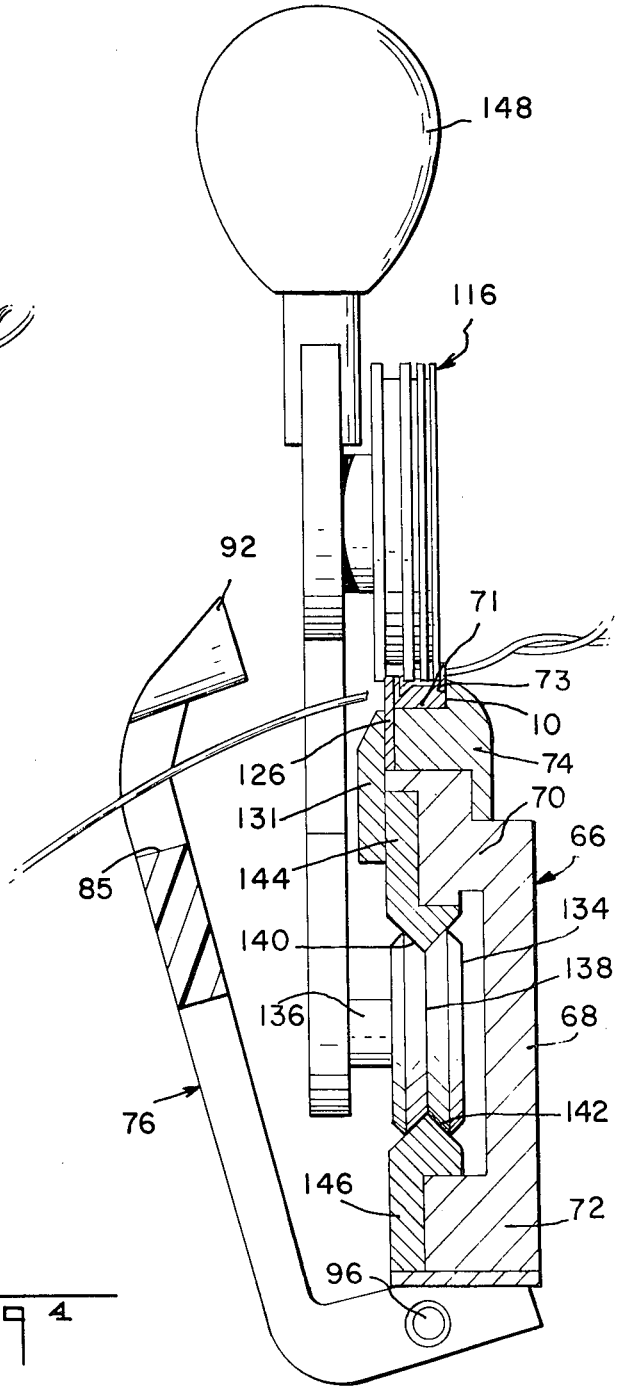
Fig 4

TELEPHONE CABLE SPLICING APPARATUS

BACKGROUND OF THE INVENTION

This invention relates to modular type electrical connectors for connecting wires in one group or bundle to the wires of a second group or bundle and to an improved apparatus for inserting the wires into the displation type contact terminals in the connector. The embodiment of the invention herein shown and described comprises a connector which is particularly intended for use in the telephone industry, however, other uses for the invention will be apparent to those skilled in the art.

The electrical cables used in telephone industry comprise a plurality of pairs of conductors which are contained in a suitable protective covering or sheath. The number of pairs in the cable may vary from a low of 25 to a high of about 3000 or more and it is frequently necessary to splice the ends of two cable sections by electrically connecting the individual wires in one of the cable ends to the wires in the other cable end.

Originally, the splicing operations were carried out by simply twisting the individual wires together but more recently connectors have been used for this purpose. Individual connectors are frequently used which connect two wires to each other so that in every splice, a number of connectors is required which is equal to the number of wires in one of the cables. Another type of connector which is now commonly used comprises an elongated connector module which has a plurality of contact terminals therein, each such terminal device being adapted to receive and connect two wires to each other. Modular connectors are frequently manufactured with 50 or more terminal devices therein so that each modular connector is capable of making a like number, 50 or more, electrical connections for the wires in the cable ends. A plurality of such modular connectors are thus required for a cable having a large number of pairs but the number of connectors required is substantially reduced as compared with individual discrete connectors.

Both types of connectors, modular and discrete, are widely used in the telephone industry and each has certain advantages for particular splicing problems.

Modular type connectors and wire insertion apparatus for telephone cable splicing are shown, for example, in U.S. Pat. Nos. 3,459,878, 3,611,264, 3,772,635 3,708,779 and in application Ser. No. 630,589 filed Oct. 10, 1975. U.S. Pat. No. 3,866,293 also has some pertinence to the instant invention. Several of these devices have found widespread acceptance in the industry, however, past experience with these previously known types of mudular connectors, and particularly, insertion tools has revealed that they lack one or more features which would be highly desirable. For example, in most of, if not all of, these known types of apparatus, a large number of wires are simultaneously inserted into the terminals of the connector so that a relatively high force is required for the inserter. This requirement of a high insertion force in turn leads to a requirement that a manually operated insertion tool have a force multiplying means or to the requirement of a tool having a pneumatic or other powered actuator. It would be desirable to avoid both of these requirements if possible. Additionally, presently available tools usually have one or more subassemblies which must be mounted on, and removed from, the tool frame by the technician during a splicing task and it would be desirable to avoid the necessity of removing parts from the apparatus. The steps of removing parts of the apparatus, such as the wire guide or the insertion head, are very inconvenient to a technician working in the cramped quarters of a manhole and the tool parts are subject to damage while so removed from the frame.

The instant invention avoids the shortcomings discussed above and others in that the apparatus, which is mechanically relatively simple, does not have removable parts although it has the capability of carrying out all of the operations of the prior art devices. Specifically, an apparatus in accordance with the invention has a wire positioner which is permanently mounted on the frame but which can be swung from its normal operative position to permit movement of the wire inserter over the connector. The inserter itself comprises a roller which moves across the surface of the connector and successively engages the individual wires and inserts them into the terminals one after another. The amount of force required to move the inserter across the connector is quite low because of the fact that the wires are inserted individually, rather than simultaneously, and the inserter can be operated manually without undue fatigue.

It is accordingly an object of the invention to provide an improved apparatus for connecting groups of wires to each other. A further object is to provide an improved cable splicing apparatus. A still further object is to provide a cable splicing apparatus which can be manually operated without undue fatigue. A further object is to provide an apparatus which is of relatively simple construction, and which can be operated without a high degree of training on the part of the technician. A further object is to provide an improved modular type electrical connector.

These and other objects of the invention are achieved in preferred embodiments thereof which are briefly described in the foregoing abstract, which are described in detail below, and which are shown in the accompanying drawing in which:

FIG. 3 is a view taken along the lines 3—3 of FIG. 2, this view showing the positions of the parts during the operation of positioning a group of wires in the wire locating and guide means of the apparatus.

FIG. 4 is a view similar to FIG. 3 but showing the positions of the parts during the wiring trimming and inserting step.

Figures 1, 2:
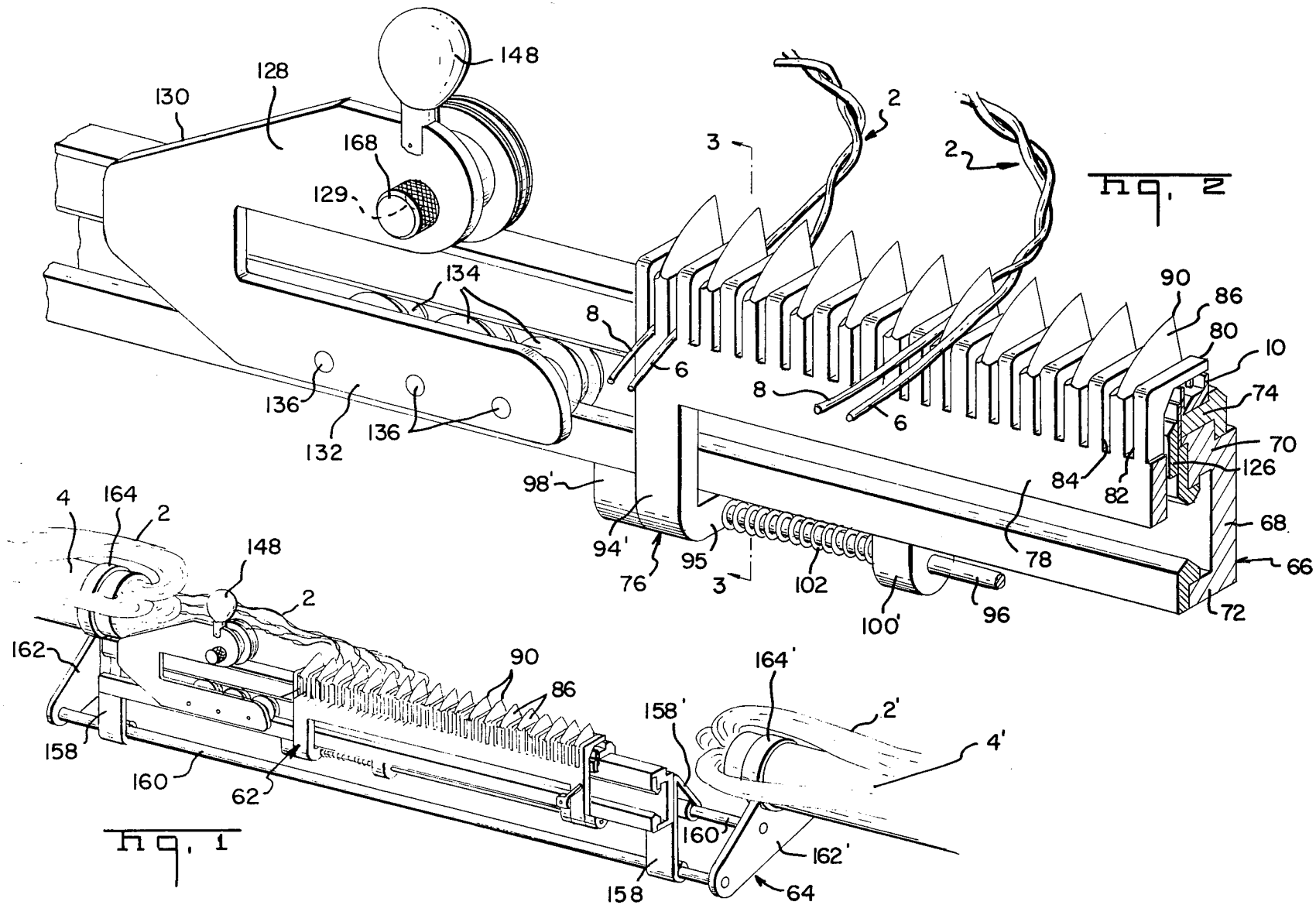
FIG. 1 is a perspective view showing an apparatus in accordance with the invention mounted proximate to the ends of two cables, the conductors of which are to be connected to each other.
FIG. 2 is a fragmentary perspective view of the central portion of the apparatus of FIG. 1 showing the wire positioning means, the frame bar, and the inserter.

A preferred form of apparatus 62 (FIG. 1) in accordance with the invention is particularly intended to connect the individual pairs 2 of wires in the end of a cable 4 to the pairs 2' in the end of an adjacent cable 4'. The electrical connections are formed in a modular connector 10, FIG. 2A which comprises a generally prismatic block 12 of molded insulating material having a smooth, continuous, and arcuately planar upper surface 14, a front side 16 and a rearward side 18. A frontwall 20 extends upwardly along one side edge of surface 14 and a rearwall 22 extends upwardly from the rearward side edge as viewed in the drawing. A plurality of terminals 24 are mounted in the block and extend normally upwardly from the surface 14. The terminals are arranged in two spaced apart parallel rows with the terminals 24 in one row being staggered relative to the terminals 24' in the row which is adjacent the rear wall 22. The terminals are stamped from conductive sheet metal and each has a generally rectangular base 26 from which ears 28 extend and which is embedded in the block 12. Three separate plate like wire-receiving portions 30, 32, 34 extend upwardly as viewed in FIG. 9, beyond the surface 14, these wire-receiving portions being separated by separator slots 36 as shown so that they are mechanically separate from each other. Each plate like section has a wire receiving slot generally indicated at 38 extending inwardly from its upper free end, the entrance portions 40 of the slots being convergent to facilitate guiding of the wires into the slots. The width of the slots 38 relative to the diameters of the wires 6, 8 is such that when a wire is moved into one of the slots, the insulation of the wire will be displaced and the edges of the slots will establish electrical contact with the conducting core of the wire. The term "displation" has been coined to describe this type of electrical contact.

The backwall 22 of the block 12 has spaced apart wire holding slots 42 (FIG. 9) which are in alignment with the individual wire-receiving slots 38 of the terminals. Slots 42 also have convergent upper ends 44 for wire guidance purposes and these slots have constrictions as shown at 46 so that after a wire has been moved into one of the slots 42 to the inner end 47 of the slot, it is captured and cannot be easily removed from the slot. It will be noted that the inner ends 47 of the slots 42 are at a level substantially above the plane of the surface 14 for reasons which will be discussed below. The frontwall 20 has similar slots 48 which are in alignment with the terminal slots 38 and with the slots 42. The slots 48 also have divergent upper ends and constricted neck portions as described above and the inner ends 49 of slots 48 are substantially at the level of the surface 14 as shown clearly in FIG. 5. It will also be apparent from FIG. 5 that a trough 50 is provided in the surface 14 which extends along backwall 22, the righthand side of this trough as viewed in FIG. 5 being inclined as shown at 51. This trough receives the end portions of the wires as is shown in FIG. 6 and as will be described below.

Figure 9:
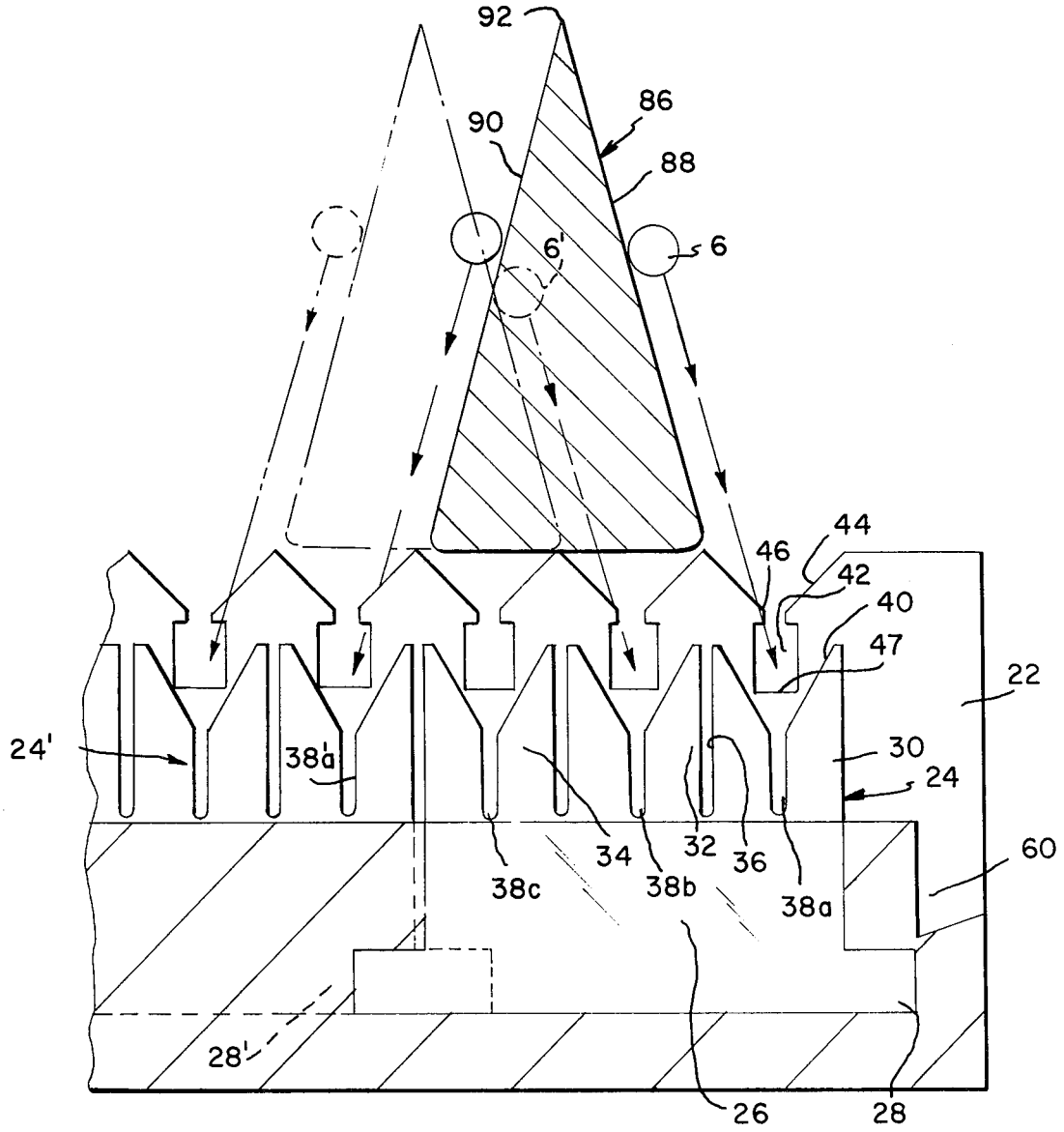
FIG. 9 is a fragmentary frontal view of a connector showing portions of wire guide means and illustrating the selective positioning of the guide means.

A cover member 52 is assembled to the block 12 after the wires have been inserted into the terminals and has spaced apart ears 56 which are received in the slots 42, 48 to provide a latching means to hold the cover member on the base 12. This cover member has a recess or groove 54 extending for its full length which receives the ends of the terminals as shown in FIG. 6. Additionally, cover member 52 has a depending rib 58 which partially fills the trough 50 and clamps the ends of the wires against the surface 51. As shown in FIG. 9, recesses or notches 60 may be provided at each end of the block 12 for the receptance of complementary depending arms at each end of the cover member.

The apparatus 62 will ordinarily be mounted as shown in FIG. 1 on a suitable support bracket 64 at a location between the ends of the cable sections 4, 4' so that a technician seated in front of the apparatus can reach towards the cable ends, grasp the wires, and locate them in the wire locating means on the apparatus. The apparatus comprises a generally channel-shaped frame bar 66 having a web or backwall 68 and upper and lower flanges or sidewalls 70, 72. The bar extends parallel to the common axis of the cables as shown in FIG. 1. A connector supporting member 74 (FIG. 3) is mounted on the external surface of the sidewall 70 and has an upper surface 71 on which the connector is supported. As shown in FIG. 3, the connector is located between a fixed shearing bar 126 and a shoulder 73 which is on the righthand side of the surface 71.

The wires 6, 8, 6', 8', of the individual pairs in the cable ends 4, 4' are located in alignment with predetermined terminals in the connector by means of a wire locating means 76 comprising an elongated plate 78 which extends beside the sidewall 70 and in front of a connector located on the connector supporting means. Plate 78 has a flange 80 which extends rearwardly over the connector and a plurality of spaced apart pairs 82, 84 of wire locating slots extend into the flange 80 and into the front plate section 78. As clearly shown in FIG. 3, the inner ends 85 of these slots are at a level substantially below that of the connector on the connector support 74. The depth of these slots permits the wire locating means 76 to be swung in a counterclockwise direction to the position shown in FIG. 4 and the wires will remain in the slots when the locating means is swung outwardly in this manner. The slots 82, 84 should have a width which is sufficient to permit the wires to move freely therethrough.

A wire splitter and guide 86 is provided on the flange 80 between each pair of associated slots 82, 84. Each splitter or guide has an apex 92 and inclined guide surfaces 88, 90 (FIG. 9) which serve to guide the wires of a pair into predetermined wire holding slots 42, 48 in the rearward wall 22 and in the frontwall 20 of the connector. It will be noted from FIG. 9 that the spacing between the two slots of each pair of slots 82 84 is the same as the spacing between corresponding plate-like portions of adjacent terminals in the two rows. In other words, this spacing is the same as the spacing between the slot 38*a'* in the terminal 24 shown at the right in FIG. 9 and the slot 38*a'* which is in the adjacent terminal 24 of the foremost row of terminals. It follows that if a pair of wires 6, 8, is split and moved over the surfaces 88, 90, the wires will be located in the wire holding slots of the connector with one wire in alignment with a predetermined wire-receiving terminal slot 38*a* in one terminal 24 and the other in alignment with the corresponding wire receiving slot 38*a'* in the terminal 24' which is immediately adjacent to the first terminal but in the back row of terminals.

Figures 2A, 10:
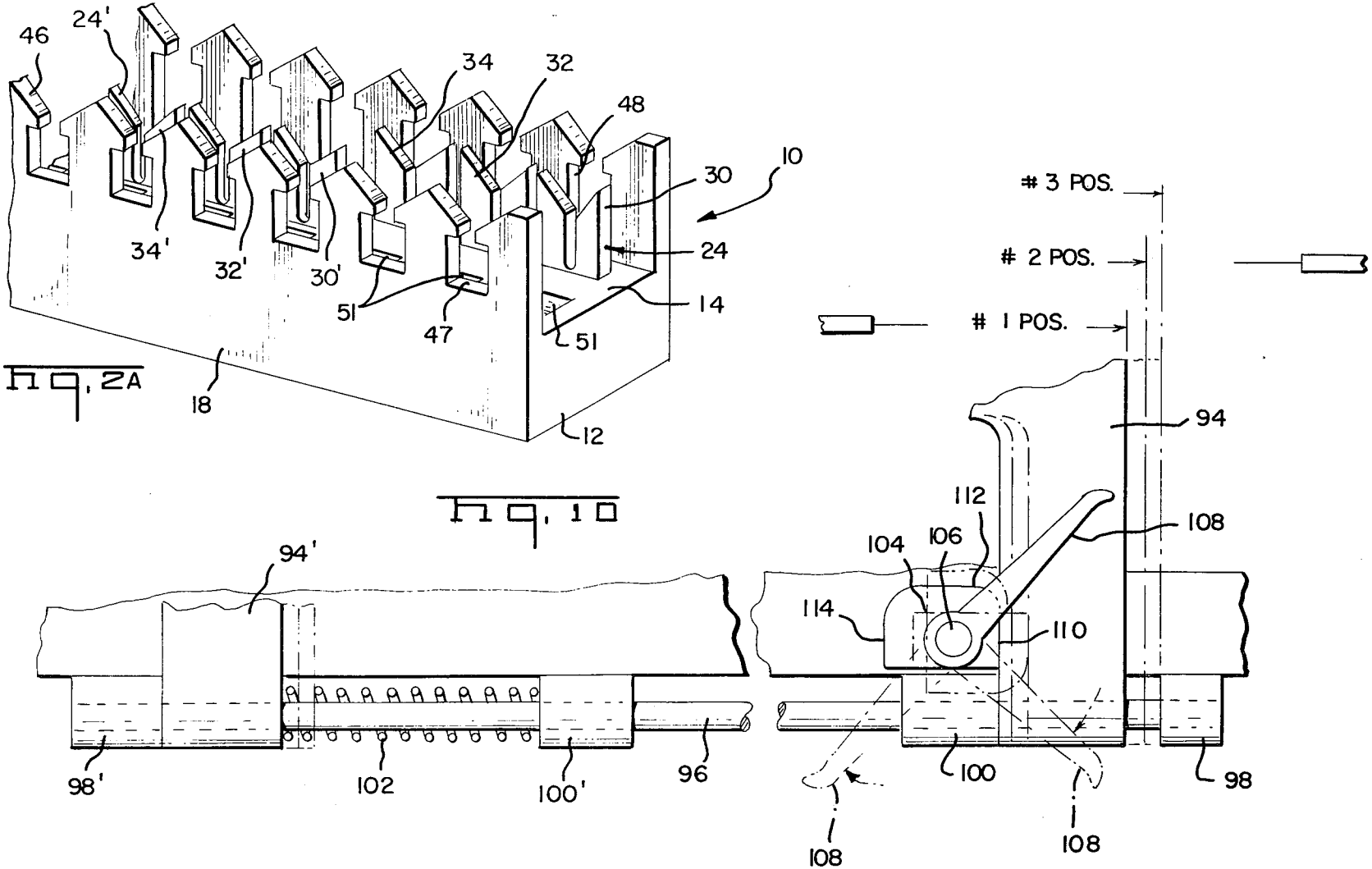
FIG. 2A is a fragmentary perspective view of a modular connector in accordance with the invention.
FIG. 10 is a fragmentary view of the rearward side of the frame and illustrating the selective positioning mechanism for the wire guide means.

The plate 78 has depending arms 94, 94' at each end thereof which extend inwardly beneath the sidewall 72 at 95, 95'0 and which are slidably mounted on a support rod 96, see FIG. 10. This rod has its ends mounted in ears 98, 98' which are secured to the sidewall 72 and it is also supported on intermediate ears 100, 100'. A spring 102 surrounds the rod 96 between the ears 98', 100' so that the locating means 76 is biased leftwardly as viewed in FIG. 10 and is against the ear 98'. The locating means can be moved rightwardly to the two dotted lines shown in FIG. 10 by means of an adjusting block 104 which is pivotally mounted on a pin 106 which extends from the frame bar. Block 104 has bearing surfaces 110, 112, 114 which are at different distances from the axis of the pin 106. To move the wire locating means 76 to the first dotted line shown to the right of the solid line position in FIG. 10, the block is rotated by the lever 108 to bring the surface 112 against the side of the support arm 94. Further rotation of the lever brings the side 114 against the arm 94 to cause the wire locating means to be moved to the position indicated by the second dotted line in FIG. 10. The significance of this feature will be explained below.

Figure 5:
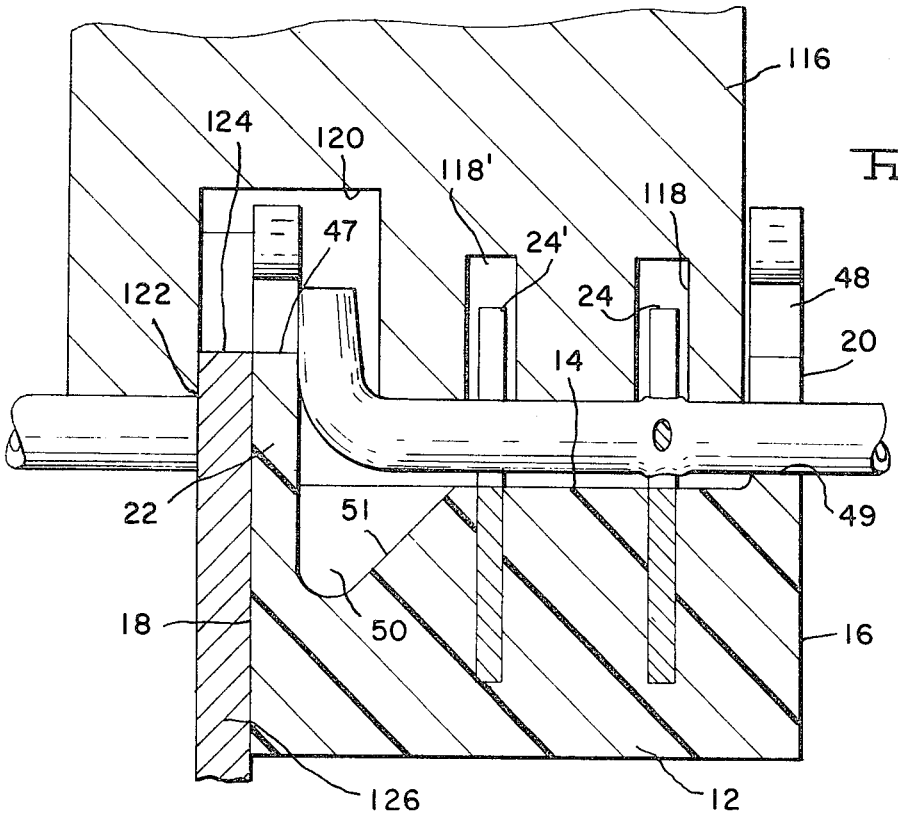
FIG. 5 is a greatly enlarged sectional view illustrating the manner in which the insertion roller trims the ends of the wires and inserts them into the contact terminals in the connector.
Figure 6:
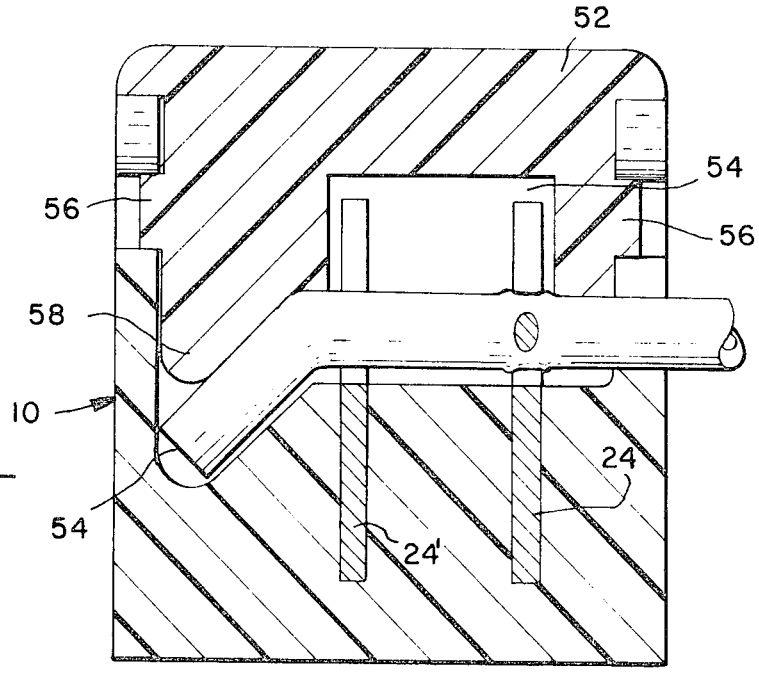
FIG. 6 is a transverse cross-sectional view of the connector showing a wire in one of the terminals and the cover member in assembled relationship to the connector body.

The inserter comprises a roller 116, FIG. 5, which is movable over the surface 14 of the connector. This roller has circumferential grooves 118, 118' which are dimensioned to provide clearance for the projecting upper ends of the terminals 24, 24' as shown in FIG. 5. During movement of the roller, the surfaces thereof, which are adjacent to the grooves 118, 118' engage the wires and move them from the wire holding slots 42, 48 in the sidewalls and into the wire receiving slots 38 38' of the terminals 24, 24'. Roller 116 has an additional groove 120 which provides clearance for the sidewall 22 and an end portion of wire after it has been severed. The edge 122 formed by the lefthand side of the groove 120 and the adjacent surface of the roller serves as a movable shearing edge in cooperation with an edge 124 of a fixed shear plate 126. This fixed plate 126 is secured by a clamping plate 131 against the free end of sidewall 70, against connector holder 74, and against a guide gib, 44 described below.

Roller 116 is mounted for rotation on a pin 129 which extends rearwardly, as viewed in FIG. 2 from the upper arm 128 of a yoke 130. This yoke has a lower arm 132 which is adjacent to the lower sidewall 72 of the frame bar 66 and three pins 136 extend inwardly from this lower arm towards the web 68 of the frame bar. Three guide rollers 134 are mounted on these pins 136 and these guide rollers have V-shaped grooves 138 on their surfaces which receive the V-shaped guiding surfaces 140, 142 of upper and lower guide gibs 144, 146 mounted on the sidewalls. It will thus be apparent that the yoke can be moved rightwardly along the length of the frame bar 68 and the insertion roller will move over the upper surface 14 of the connector block 12 during such movement of the yoke. Three rollers 134 are provided in order to adequately support connectors during insertion of the wires. Advantageously, a knob 148 is mounted on the upper arm 128 of the yoke which is adapted to be grasped by the technician when he moves the insertion roller across the frame bar.

As previously noted, the apparatus is supported at the worksite in a manner which is convenient for a technician making the splice. In the disclosed embodiment, the supporting means comprises V-shaped brackets 158, 158' which are secured to the ends of the frame bar 66 and which have their arms supported on spaced apart support bars 160 which extend between support arms 162, 162' which are secured to the ends of the cables 4, 4' by suitable clamps 164, 164'.

In use, and assuming that the apparatus is being used for a conventional cable splicing operation, the cable ends are prepared as shown in FIG. 1 with the conductors extending rearwardly from the cable ends and tied to the surface of the cable. The apparatus is mounted on the cable ends as shown, a connector is placed on the connector support 74, and the lever 108 is moved to the position shown in FIG. 10. The operator then selects a plurality of pairs 2 from the end of the cable 4 and moves each pair downwardly over one of the pair splitting projections 86. As illustrated in FIG. 9, movement of a pair of wires over a splitter 86 will locate one of the wires 6 in the aligned slots 42, 48 which are in alignment with a wire-receiving slot 38*a* of a terminal 24 and the other wire 8 will be located in the slots 42, 48 which are in alignment with the corresponding wire receiving slots 38*a'* of the adjacent connector 24'. After a number of pairs from the cable 4 which is equal to the number of terminals 24 or 24' in each of the rows of the connector have been so positioned in the slots 42, 48, the operator swings the wire locating means 76 from the position of FIG. 3 to the position of FIG. 4. The wires remain in the slots 82, 84 of the wire positioning means as previously noted and the portions of the wire which are adjacent to the connector are held in the slots 42, 48 of the connector. The operator then grasps the knob 148 and moves it rightwardly from the position of FIG. 1 over the connector. During such movement, the end portions of the wires are trimmed by the shearing edges 124, 122 and the wires are moved downwardly into the slots 38*a, 38a'* of the terminals. The operator then returns the yoke to its original position as shown in FIG. 1 and swings the wire-positioning means to its position as shown in FIG. 3. He then swings the lever 108, FIG. 10, to the first dotted line position so that the positioning means is indexed from the solid line position of FIG. 9 to the adjacent dotted line position thereof. The technician then selects wire pairs 2' from the end of the cable 4' and repeats the process described above. During this phase, the wires 6' 8' will be placed in alignment with the slots 38*b, 38b'* of the terminals 24, 24'. He then repeats the steps of swinging the wire positioning means to the position of FIG. 4 and moving the inserter arm its working stroke.

Figure 7:
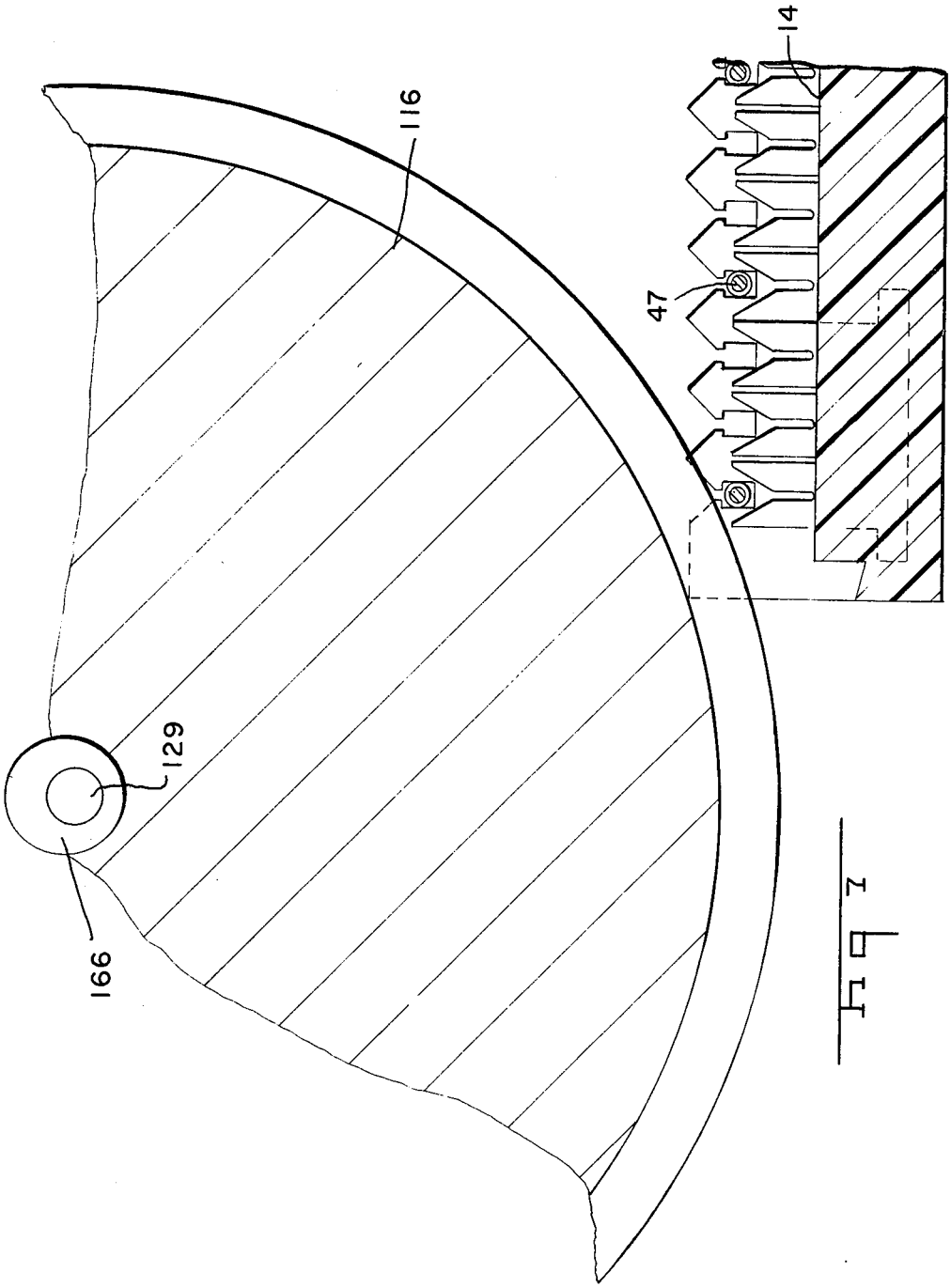
FIG. 7 is a fragmentary frontal view showing a portion of the insertion roller and a portion of a connector having wires located therein preparatory to trimming and insertion of the wires into the contact terminals.
Figure 8:
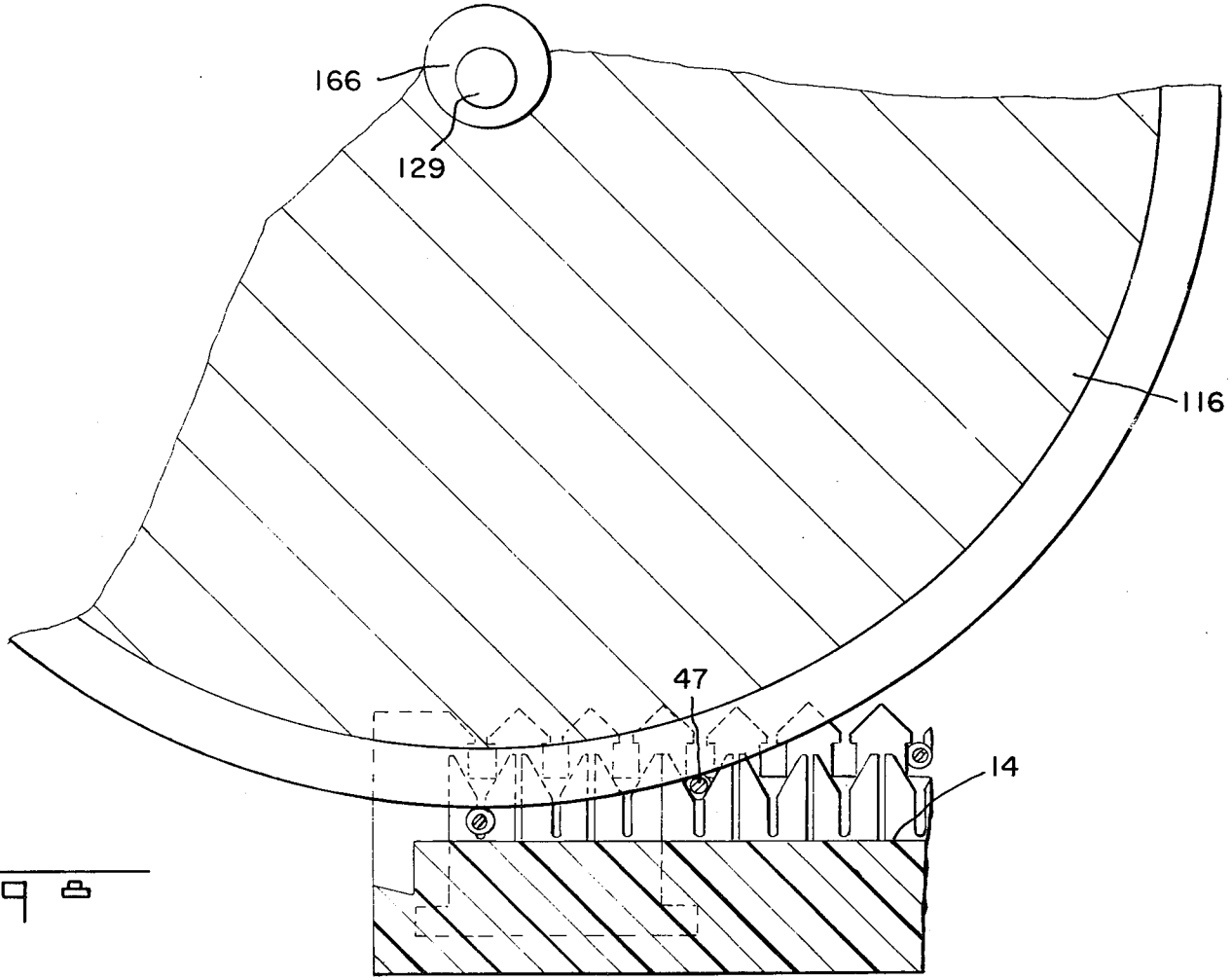
FIG. 8 is a view similar to FIG. 7 showing the roller in engagement with some of the wires, that is, showing the roller midway through its working stroke.

After wires have been inserted into the slots 38*a, 38b, 38a', 38b'* a number of pairs from each cable end will have been connected to each other and the operator places the cover member 52 on the connector base. The cover may be simply snapped onto the base or may be rolled on by the roller 116. To this end, an adjustment feature may be provided to raise the axis of the pin 129 so that the roller will move over the surface of the upper surface of the cap member. In the disclosed embodiment, the adjustment comprises a bushing means 166 having an eccentric bore extending therethrough in which the pin 129 is supported. The bushing can be rotated by means of a handle 168 and moved between two positions such that the axis of the pin 129 is located as shown in FIG. 7 in one position and the axis of the pin 129 is raised when the bushing means is in its other position so that the roller can be used to press the cap member onto the connector body. The roller, in turn, is supported in the pin 129 as described.

The slots 38c, 38c' are provided in the terminals 24, 24' to provide the capability for making tap connections. To make such tap connections, the tap wires are simply treated as are the wire pairs in the cable ends. The wire positioning means is indexed to the second dotted line position by the positioning block 104 to locate the wire splitters such that they will deliver wires to the slots 38c 38c'.

A significant advantage of an apparatus in accordance with the invention is that very little effort is required to trim the wires and insert them into the terminals because of the fact that the wires are trimmed and inserted successively as the insertion roller moves over the connector. The force required to trim and insert an individual wire is very slight so that the effort required to move the inserter would not tax a person of moderate strength. It follows that it is totally unnecessary in the practice of the invention to provide a pneumatic power inserter or a complex force multiplying manually operated inserter. This feature is distinctly advantageous under the circumstances encountered in cable splicing operations, for example, in a manhole or on an elevated platform.

It will also be apparent from the foregoing description that all of the parts of the apparatus remain on the apparatus during the entire work cycle. It is not necessary to remove a separate insertion tool from the frame or to remove a separate wire positioner. These parts are not subject to loss or damage as are parts which must be removed.

Figure 12:
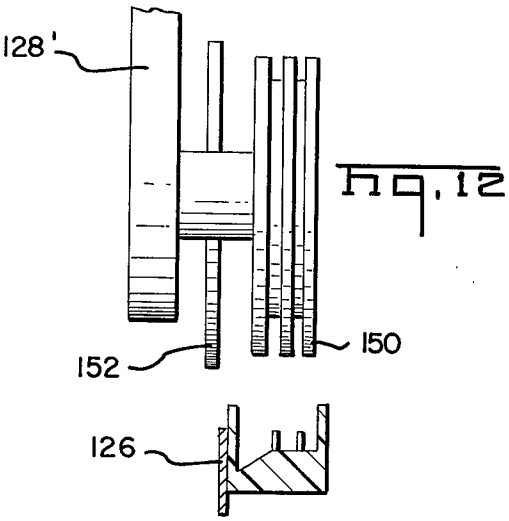
FIG. 12 is an end view of the inserter of FIG. 11 showing the inserter in alignment with a connector.
Figure 11:
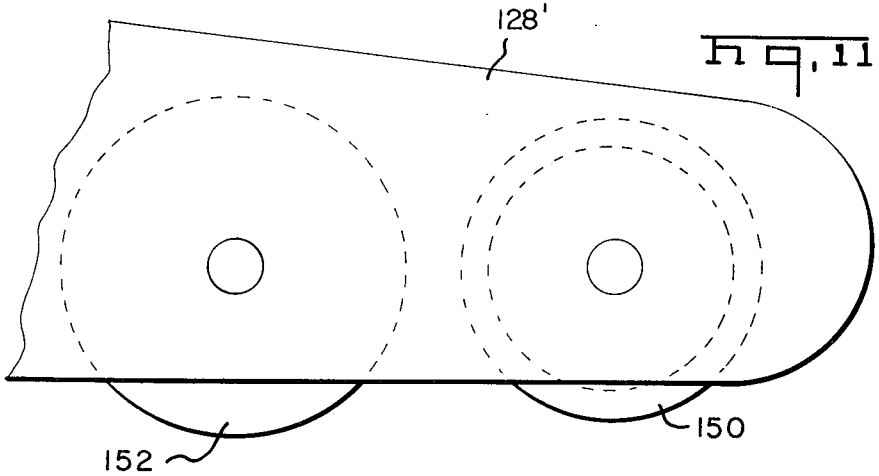
FIG. 11 is a fragmentary view of an alternative form of inserter.

FIGS. 11 and 12 show an alternative embodiment in which the wires are inserted into the terminals by one roller 150 and the wires are later cut or trimmed by a second roller 152 which cooperates with the previously described fixed shearing member 126. Both of these rollers are mounted on suitable pins on an upper arm 128' of the yoke. This arrangement may be favored under some circumstances because of the fact that the wires are fully inserted into the terminals prior to their being cut so that at no time during insertion are the wires not under complete control. That is, during and after insertion the wires are in the notches or slots in the sidewalls of the connector holder and after the wires have been fully inserted and are mechanically held in the terminals, they are cut. It has been found, however, that very good results can be achieved with the previously described embodiment.

Figure 14:
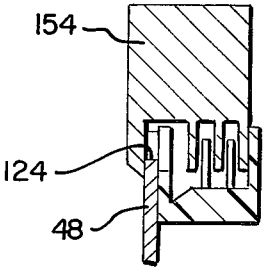
FIG. 14 is a view taken along the line 14—14 of FIG. 13.
Figure 13:
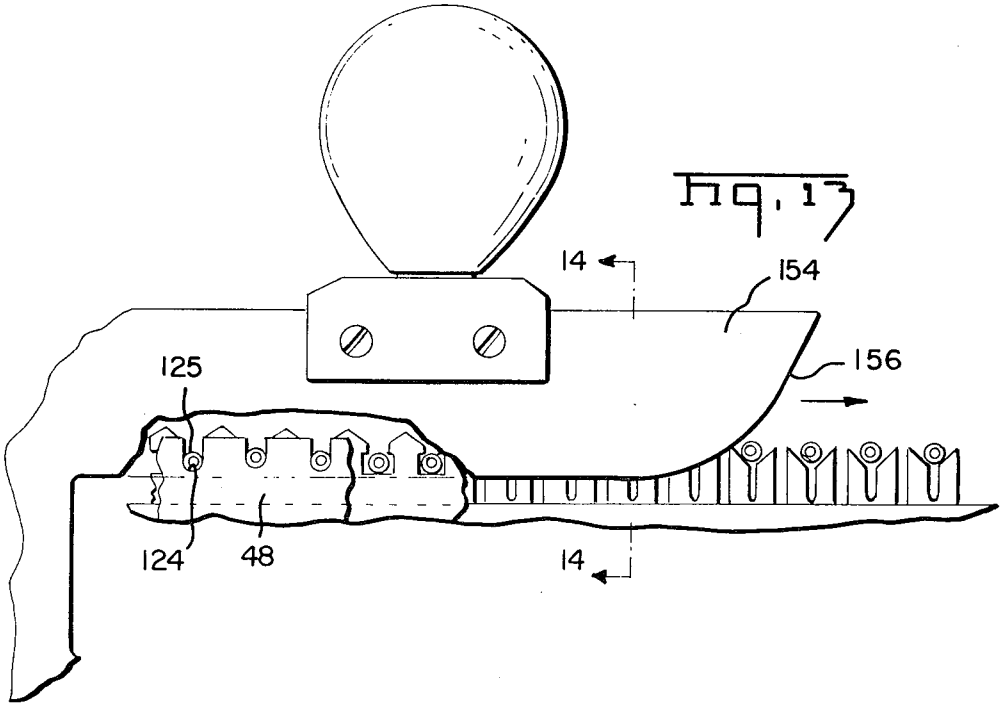
FIG. 13 is a fragmentary view of a further embodiment having another type of inserter.

FIGS. 13 and 14 show a further embodiment in which the inserter 154 comprises a block, rather than a rotating member, which moves across the connector and forces the wire into the terminals. The block has a curved prow 156 to facilitate downward movement of the wires and it also has a movable shear as shown in FIG. 14.

In this embodiment, it is desirable to provide notches 125 in the shear bar, the cutting edges 124 being at the inner ends of these notches. The notches 125 prevent the wires from being pushed rightwardly by the inserter rather than being inserted as desired.

The embodiment of FIG. 13 is simplified somewhat in that the roller is not required and may be entirely satisfactory under some circumstances, however, the use of a roller is preferred for the reason that during insertion of the wires there is little or no relative movement of the wires with respect to the surface of the roller. Each wire is moved downwardly into one of the terminals while the portion of the surface of the roller which is in engagement with the wire travels along a circular path which has vertical downward component that matches or approximates the downward movement of the wires. There is thus less of a tendency for a roller to push the wires horizontally than is the case with an inserter block. The notches 125 are thus not required in the embodiment of FIG. 1.

What is claimed is:

1. Apparatus for inserting wires into the plate-like wire-receiving portions of electrical contact terminals, said wire-receiving portions extending from a planar surface of a connecting device, said wire-receiving portions being arranged in side-by-side co-planar relationship in a row, said apparatus comprising:

connecting device supporting means for supporting said connecting device in a predetermined orientation, a wire inserter for moving said wires laterally of their axes and into said wire-receiving portions of said terminals, guide means for guiding said inserter along a wire inserter working stroke path which extends parallel to, and across, said planar surface of a connecting device on said connecting device supporting means and parallel to said row of wire-receiving portions, said wire inserter having smooth continuous surface portions which move across said planar surface during movement of said inserter along said path, said inserter having a continuous slot extending into said surface portions, said slot being dimensioned to receive and provide clearance for said wire-receiving portions of said terminals during movement of said inserter along said working stroke path whereby, upon locating said wires in side-by-side spaced apart relationship with the axes of said wires extending across said row and with said wires in alignment with said wire-receiving portions, and upon movement of said inserter along said path, said wires are successively pushed into said wire-receiving portions of said terminals by said surface portions of said inserter.

2. Apparatus as set forth in claim 1, said inserter comprising a roller, said surface portions comprising cylindrical surface portions of said roller.

3. Apparatus as set forth in claim 1 including wire locating means for locating said wires in side-by-side relationship with the axes of said wires extending transversely of said row and with said wires in alignment with said wire-receiving portions of said terminals in a connecting device on said supporting means.

4. Apparatus as set forth in claim 3, said wire locating means comprising a member having spaced-apart wire guide slots therein, said wire locating means being normally positioned on said apparatus and extending parallel to said planar surface of a connecting device on said connecting device supporting means with said wire guide slots in alignment with said wire-receiving portions of said terminals, said wire locating means being movable from said normal position to provide clearance for movement of said inserter along said working stroke path.

5. Apparatus as set forth in claim 1, said connecting device supporting means having a fixed cutting edge extending beside a connecting device on said connecting device supporting means and parallel to said working stroke path, said inserter having a movable cutting edge thereon, said movable cutting edge being cooperable with said fixed cutting edge to trim said wires during movement of said inserter along said working stroke path.

6. Apparatus as set forth in claim 2, said connecting device supporting means having a fixed cutting edge extending beside a connector on said connecting device supporting means and parallel to said working stroke path, said roller having a circumferentially extending movable cutting edge, said movable cutting edge being cooperable with said fixed cutting edge to trim said wires during movement of said roller along said working stroke path.

7. Apparatus as set forth in claim 2, said connecting device supporting means having a fixed cutting edge extending beside a connector on said connecting device supporting means and parallel to said working stroke path, a movable cutter which is cooperable with said fixed cutting edge, said guide means being effective to guide said movable cutter along said working stroke path whereby said wires are trimmed by said movable cutter upon movement of said cutter along said working stroke path.

8. Apparatus for electrically connecting wires selectively to each other by means of an electrical connector of the type comprising an insulating body having a plurality of electrical terminals extending therefrom, each of said terminals having first and second wire receiving portions which are adapted to receive wires upon movement of said wires laterally of their axes and into said wire receiving portions, said apparatus comprising:

connector supporting means, wire locating means, said wire locating means having a plurality of spaced-apart wire guide means thereon, the distance between adjacent wire guide means being equal to the distance between corresponding wire-receiving portions in adjacent ones of said terminals, selective positioning means for selectively positioning said wire-locating means in first and second selective positions relative to a connector on said connector supporting means, said wire guide means being in alignment with said first wire-receiving portions of said terminals when said wire-locating means is in said first position, said wire guide means being in alignment with said second wire-receiving portions of said terminals when said wire locating means is in said second position whereby, upon positioning a connector on said supporting means, positioning said wire locating means in said first selective position, locating wires of a first group of wires in said wire guide means, inserting said wires from said first bundle into said first wire receiving portions of said terminals, positioning said wire locating means in said second selective position, locating wires of a second group of wires in said spaced apart wire guide means, and inserting said wires from said second bundle and into said second wire receiving portions of said terminals, said wires in said first group are connected to said wires in said second group.

9. Apparatus as set forth in claim 8, said wire locating means comprising a locating bar, said locating bar having a normal location in which said bar extends parallel to a connector on said connector supporting means and proximate to said terminals, said guide means comprising guide slots in said locating bar.

10. Apparatus as set forth in claim 8, said apparatus being intended for use with a connector in which said wire-receiving portions are in a row, said wire locating means comprising a locating bar, said locating bar being normally located in a normal location in which it extends parallel to a connector on said connector supporting means and beside said row, said guide means comprising guide slots in said locating bar, said selective positioning means being effective to index said bar in a direction parallel to said row.

11. Apparatus as set forth in claim 10, said apparatus being intended for use under circumstances in which said groups of wires each comprises a plurality of pairs of wires, said guide means having pair separating means between the slots of adjacent pairs of slots.

12. Apparatus for electrically connecting a first plurality of pairs of wires in a first bundle of wire pairs to a second plurality of pairs of wires in a second bundle of wire pairs by means of multi-contact electrical connector, said connector comprising a body portion having an elongated planar surface, a plurality of electrical contact terminals in said body portion, said terminals having wire-receiving portions extending from said planar surface, said wire-receiving portions being adapted to receive wires upon movement of said wires laterally of their axes and into said wire-receiving portions, said wire-receiving portions being arranged in side-by-side relationship in a row which extends across said planar surface, said apparatus comprising:

frame means, said frame means having connector supporting means for supporting said connector in a predetermined position, wire separating and guide means, said separating and guide means having a normal location in which it is disposed proximate to said planar surface, said wire separating and guide means having surface portions which are effective to separate a pair of wires which are moved towards said surface and to guide one of said wires to a location adjacent to said wire receiving portion of one of said terminals and to guide the other wire of the pair to a location adjacent to the wire-receiving portions of an adjacent terminal, a wire insertion roller for moving wires which have been located in alignment with said wire-receiving portions laterally of their axes towards said planar surface and into said wire-receiving portions, guide means on said frame means for guiding said insertion roller along a wire inserter working stroke path which extends parallel to, and across said planar surface of a connecting device on said connecting device supporting and parallel to said row, said wire inserting roller having surface portions which move over said planar surface during movement of said insertion roller along said path, said insertion roller having a continuous slot extending into said surface portions, said slot being dimensioned to provide clearance for said wire-receiving portions of said terminals during movement of said insertion roller along said working stroke path, said wire separating and guide means being movable from said normal location and away from a connector on said connector supporting means whereby, upon positioning a connector on said connector supporting means, positioning said wire separating and guide means in its normal location, moving each of said pairs of wires in said first and second bundle selectively over said wire separating and guide means to locate corresponding wires in corresponding wire pairs in said bundles in alignment with said wire-receiving portions, thereafter moving said wire separating and guide means away from said normal location to a location remote from said connector, and thereafter moving said roller along said working stroke path, said wires are inserted into said terminals.

13. Apparatus as set forth in claim 12, said apparatus being intended for use with a connector in which said wire-receiving portions are arranged in two parallel rows, said surface portions of said wire separating and guide means being effective to separate a pair of wires and guide one of said wires into said wire-receiving portion of a terminal in one row and guide the other wire into the wire-receiving portion of an adjacent terminal in the other row.

14. Apparatus as set forth in claim 13, each of said terminals having two of said wire-receiving portions, said two wire-receiving portions being side-by-side and being spaced apart in the direction of said rows by a predetermined distance, said apparatus having selective positioning means for indexing said wire separating and guide means in the direction of said rows by a distance equal to said predetermined distance whereby, the first and second wires in each pair of said first bundle can be connected to said terminal in said one row and said other row respectively when said wire separating and guide means is in one position, and the first and second wires in each pair of said second bundle can be connected to said terminals in said first and second rows respectively when said wire separating and guide means in a second position as determined by said selective positioning means.

15. Apparatus for inserting wires into the plate-like wire-receiving portions of electrical contact terminals, said wire-receiving portions extending from a planar surface of a connecting device, said wire-receiving portions being arranged in side-by-side co-planar relationship in a row, said apparatus comprising:

connecting device supporting means for supporting said connecting device in a predetermined orientation, a wire inserter for moving wires laterally of their axes and into said wire-receiving portions of said terminals, guide means for guiding said inserter along a wire inserter working stroke path which extends parallel to, and across, said planar surface of a connecting device on said connecting device supporting means and parallel to said row of wire-receiving portions of said terminals, said wire inserter having smooth continuous surface portions which move across said planar surface of said connecting device during movement of inserter along said path, said inserter having a continuous slot extending into said surface portions, said slot being dimensioned to receive, and provide clearance for, said wire-receiving portions of said terminals during movement of said inserter along said working stroke path, wire locating means for locating wires in side-by-side relationship with the axes of said wires extending transversely of said row of wire-receiving portions in a connecting device on said supporting means with said wires in alignment with said wire-receiving portions of said terminals, fixed cutting edge means extending beside a connecting device on said connecting device supporting means and parallel to said working stroke path, said inserter having a movable cutting edge means thereon which is cooperable with said fixed cutting edge means during movement of said inserter along said working stroke path whereby, upon locating said wires in said wire locating means with the end portions of said wires extending past said fixed cutting edge, and upon movement of said inserter along said path, said wires are successively trimmed by said fixed and movable cutting edge means and pushed into said wire-receiving portions of said terminals by said surface portions of said inserter.

* * * * *